US005674021A

United States Patent [19]

Hutnick

[11] Patent Number: 5,674,021

[45] Date of Patent: Oct. 7, 1997

[54] COVER FOR HOLDING TRANSCRIPT AND EXHIBIT PAGES AND METHOD OF MAKING SAME

[76] Inventor: Maria Hutnick, 14 Saddler Dr., Medford, N.J. 08055

[21] Appl. No.: 745,402

[22] Filed: Nov. 8, 1996

[51] Int. Cl.[6] ..... B42F 13/06

[52] U.S. Cl. ..... 402/14; 402/18; 281/29; 281/37

[58] Field of Search ..... 402/4, 14, 15, 402/18, 70, 80 R; 281/15.1, 21.1, 29, 37

[56] References Cited

U.S. PATENT DOCUMENTS

| | | | |
|---|---|---|---|
| 894,478 | 7/1908 | Blaine, Jr. | 402/14 |
| 1,240,058 | 9/1917 | Kiso | 402/14 X |
| 1,730,371 | 10/1929 | Jung . | |
| 1,861,459 | 6/1932 | Smith . | |
| 1,885,076 | 10/1932 | Bustamante . | |
| 2,136,186 | 11/1938 | Frost | 281/29 |
| 2,205,692 | 9/1940 | Johnson et al. | 35/51 |
| 2,336,619 | 12/1943 | Karlen | 402/18 |
| 3,038,742 | 2/1962 | Leap | 291/29 |
| 3,092,400 | 6/1963 | Smith | 281/19.1 |
| 3,099,463 | 7/1963 | Lennartz | 281/19.1 |
| 3,367,340 | 2/1968 | David et al. | 129/39.5 |
| 3,565,462 | 2/1971 | Gottlieb | 281/3 |
| 4,991,767 | 2/1991 | Wyant | 229/1.5 |
| 5,174,674 | 12/1992 | Norwood | 402/73 |
| 5,340,156 | 8/1994 | Bianco | 289/37 |
| 5,358,278 | 10/1994 | Ellis | 281/31 |
| 5,380,043 | 1/1995 | Schwartz | 281/15.1 |

*Primary Examiner*—Willmon Fridie, Jr.

*Attorney, Agent, or Firm*—Caesar, Rivise, Bernstein, Cohen & Pokotilow, Ltd.

[57] ABSTRACT

A cover for holding multiple pages containing transcribed oral testimony and exhibits mentioned in those transcript pages. The cover comprises front, center and back panels that are joined by means of hinges. The front panel is arranged to swing from a stored position overlying the center panel to an open position. The cover is also provided with an attachment device located between the front and center panels for securing the transcript pages therein. The attachment device enables a reader to swing multiple transcript pages from a position overlying the center panel to a position overlying the cover panel when the cover panel is in the open position. The back panel is arranged to swing from a stored position wherein the back panel is in overlying relationship with the center panel to an open position. The back panel also comprises a binding means secured thereto which is arranged for securing exhibits within the cover. The binding means is arranged to enable the reader to swing exhibits from a first position overlying the back panel to a second position that does not obstruct the reader's view of the transcript pages thus enabling simultaneous viewing of transcript pages and exhibits mentioned therein and enabling the reader to turn pages of transcript and exhibits independently of one another.

24 Claims, 2 Drawing Sheets

COVER FOR HOLDING TRANSCRIPT AND EXHIBIT PAGES AND METHOD OF MAKING SAME

BACKGROUND OF THE INVENTION

A deposition is a discovery method used by attorneys in preparation for a trial. During a deposition, one party asks oral questions of the other party or of another witness. The person who is deposed is called the deponent. The deposition is conducted under oath outside of the courtroom, usually in one of the lawyer's offices. A transcript, i.e., a word for word account of the questions asked and responses given during the course of the deposition, is made stenographically by a court reporter. Often, during the course of the deposition, the deponent will be asked to answer questions about documents and other physical things that are introduced. During the deposition, it is usual practice to assign numbers to these exhibits so that after conclusion of the deposition, one reading the transcript can refer to the exhibits being discussed in the transcript by looking for the number appearing on the exhibit. Normally, after the deposition is concluded, the reporter copies the exhibits and transcript pages, arranges them within a cover with the exhibits behind the transcript pages and makes them available to counsel upon request and payment of a fee.

The prior art deposition transcript cover is a two-panel book-cover-like construction, i.e., front and back panels that are hingedly joined along adjacent side edges to enable opening and closing of the cover and turning of the transcript and exhibit pages secured therein just like the pages of a book. Typically, under the prior art construction, a securement device for fastening multiple pages is provided as part of the hinge joining the front and back panels. In using this prior art construction, it is the accepted practice to fasten both the transcript and exhibit pages to this single securement device with transcript pages arranged on top and the exhibit pages arranged on bottom within the cover. In other words, in the prior art construction, transcript and exhibit pages are stacked in one pile and are not secured independently from one another within the cover.

While this prior art cover may achieve its intended purpose of containing transcript and exhibit pages in one place so as to prevent loss of the pages, it nevertheless suffers from one or more drawbacks. In particular, since the transcript and exhibit pages are stacked in one pile and held by a common securement device with exhibit pages located on the bottom, it is impossible for the reader to view any of the exhibits without first turning over all of the transcript pages lying thereover. Therefore, under the prior art arrangement, transcript pages actually block the reader's view of the exhibit pages located thereunder. To refer to the exhibit pages, it is necessary for the reader to first mark his/her reading place within the transcript pages, then turn to the last page of the transcript after which the exhibit pages begin, then find the exhibit being referred to. Such page marking, turning and hunting for exhibits is cumbersome and distracting and can actually result in the reader losing his/her concentration and train of thought. Because both transcript and exhibit pages are secured by a single securement device, the prior art cover also suffers a drawback in that it does not enable the reader to turn transcript pages independently of exhibit pages. Likewise, the prior art cover does not enable the reader to turn exhibit pages independently of transcript pages. The ability to turn transcript and exhibit pages independently of one another increases the reader's ease of referring back and forth between these two documents and eliminates the necessity for marking the reader's place in the transcript.

In an alternative two-panel prior art construction, rather than being held with the transcript pages, the exhibit pages are fastened to the inside surface of the back panel by any conventional means, e.g., stapling. Although this construction may have some benefit over the first prior art construction mentioned above in that it enables the reader to turn exhibit pages independently from transcript pages, thus increasing the reader's ease in referring back and forth between these two documents, it also suffers from one or more drawbacks. In particular, under this alternative prior art construction, when the cover is opened, the unread transcript pages still lie over and block the exhibit pages. In order to view the exhibit pages, the reader still must mark his/her reading place in the transcript pages, turn to the last transcript page and hunt for the particular exhibit being referred to in the transcript. This is also a cumbersome arrangement in that a reader can easily lose his/her place in the transcript pages while hunting for an exhibit mentioned therein.

This invention relates generally to a multi-panel cover and in particular to a three panel cover for holding transcript pages and exhibits referred to in those transcript pages in a unique manner heretofore not employed. Since the cover is a three panel construction rather than two, it secures transcript pages in a manner that enables the reader to turn transcript pages held therein between the first and second panels so as to not obstruct the reader's view of the exhibit pages attached to the third panel. In use, unread transcript pages do not lie over and do not obstruct the reader's view of exhibit pages. Likewise, exhibit pages are held within the inventive folder in a manner that enables a reader to turn exhibit pages in a manner and direction that will not interfere with or block from the reader's view the transcript pages. In other words, the inventive cover enables the reader to read the transcript and easily refer to exhibits mentioned in the transcript without the necessity of marking his/her reading place within the transcript pages, turning to the end of the transcript pages and hunting through the exhibits, thereby minimizing the potential for losing his/her reading place in the transcript and losing his/her train of thought.

The inventive cover enables the reader to turn transcript pages independently of exhibit pages and visa-versa, thus enabling ease of use and reference. The cover is also inventive in that it folds from its open position wherein all three panels lie in an adjacent, side-by-side relationship to one another, to its compact closed state in which the panels overly each other to provide a cover having the size of a single panel, thus providing a manageable size for transporting and storage. This invention also relates generally to a method of making such an inventive cover for transcript pages and exhibits.

OBJECTS OF THE INVENTION

It is a general object of the present invention to provide a transcript page and exhibit cover that overcomes the disadvantages of the prior art.

It is another object of this invention to provide a transcript page and exhibit cover that enables a reader to turn transcript pages independently of exhibit pages and, likewise, enables a reader to turn exhibit pages independently of transcript pages.

It is another object of this invention to provide a transcript page and exhibit cover that is simple in construction.

It is yet another object of this invention to provide a transcript page and exhibit cover that is inexpensive to manufacture.

It is another object of this invention to provide a transcript page and exhibit cover that is reliable in operation and easy to use.

It is another object of this invention to provide a transcript page and exhibit cover that enables a reader to more easily locate exhibits being referred to in the transcript pages.

It is another object of this invention to provide a transcript page and exhibit cover that is compact, manageable in size and portable.

SUMMARY OF THE INVENTION

The above and other objects are achieved in a cover for holding multiple pages containing transcribed oral testimony and exhibits mentioned in those transcript pages. The cover comprises front, center and back panels that are joined by means of hinges. The front panel is arranged to swing from a stored position overlying the center panel to an open position. The cover also is provided with an attachment device located between the front and center panels for securing transcript pages therein. The attachment device enables a reader to swing multiple transcript pages from a position overlying the center panel to a position overlying the cover panel when the cover panel is in the open position.

The back panel is arranged to swing from a stored position wherein the back panel is in overlying relationship with the center panel to an open position. The back panel also comprises a binding means secured thereto which is arranged for securing exhibits within the cover. The binding means is arranged to enable the reader to swing exhibits from a first stored position overlying the back panel to a second use position that does not obstruct the reader's view of the transcript pages, thus enabling simultaneous viewing of transcript pages and exhibits mentioned therein and enabling the reader to turn pages of transcript and exhibits independently of one another.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
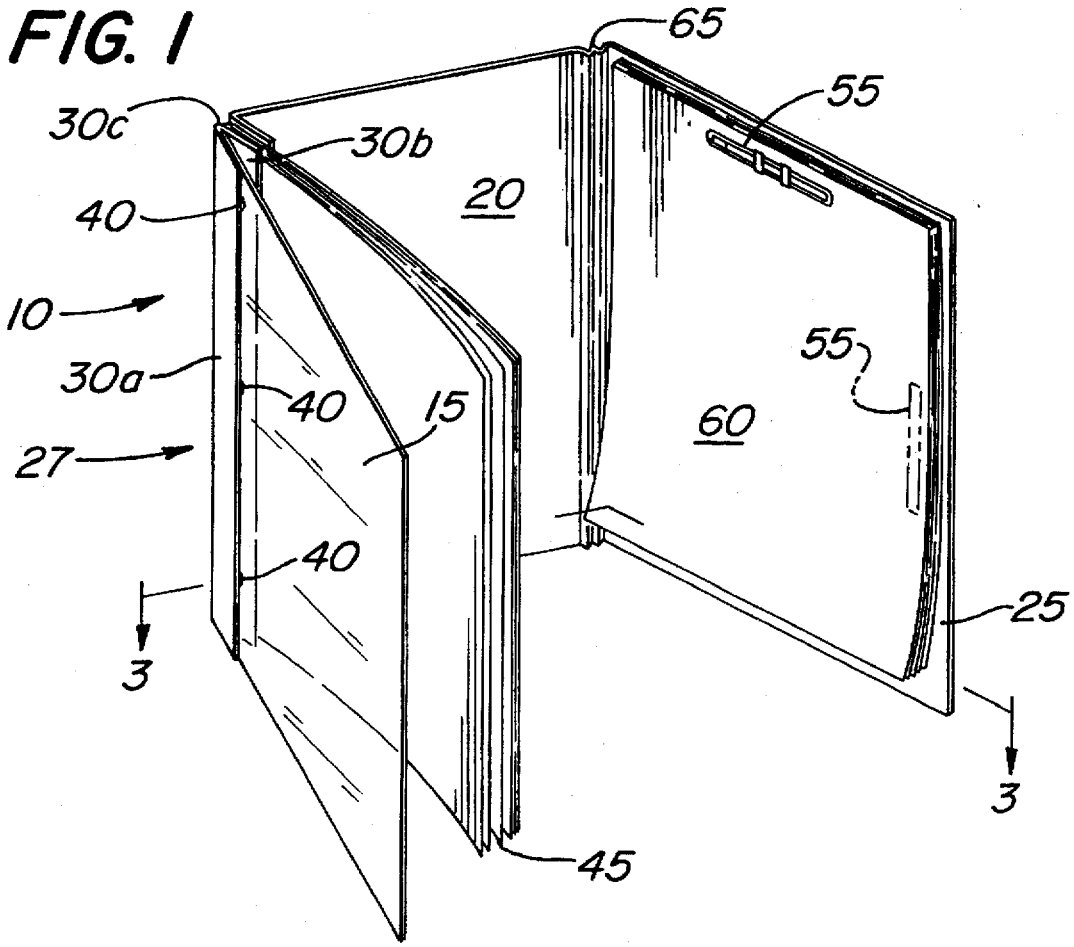
FIG. 1 is an isometric view of the preferred embodiment of the present invention in a partially opened condition.

Referring now to various figures of the drawings where like reference numerals refer to like parts, there is shown at 10 in FIGS. 1 through 4 the preferred embodiment of the cover for transcript pages and exhibits constructed in accordance with this invention.

The details of the cover 10 will be described later. Suffice it for now to say that the preferred embodiment of the improved cover 10 comprises a front panel 15, which is preferably transparent, a center panel 20 and a back panel 25 that are hingedly joined as shown in FIGS. 1 through 4. The cover 10 is provided with a page securement device 27 located between the front 15 and center 20 panels for holding a first set of pages 45, e.g., transcript pages. Said pages 45 have been three-hole punched along the length of the left margin. The cover 10 also is provided with a binder 55 located on the back panel 25 for holding a second set of pages 60, e.g., exhibits.

Figure 2:
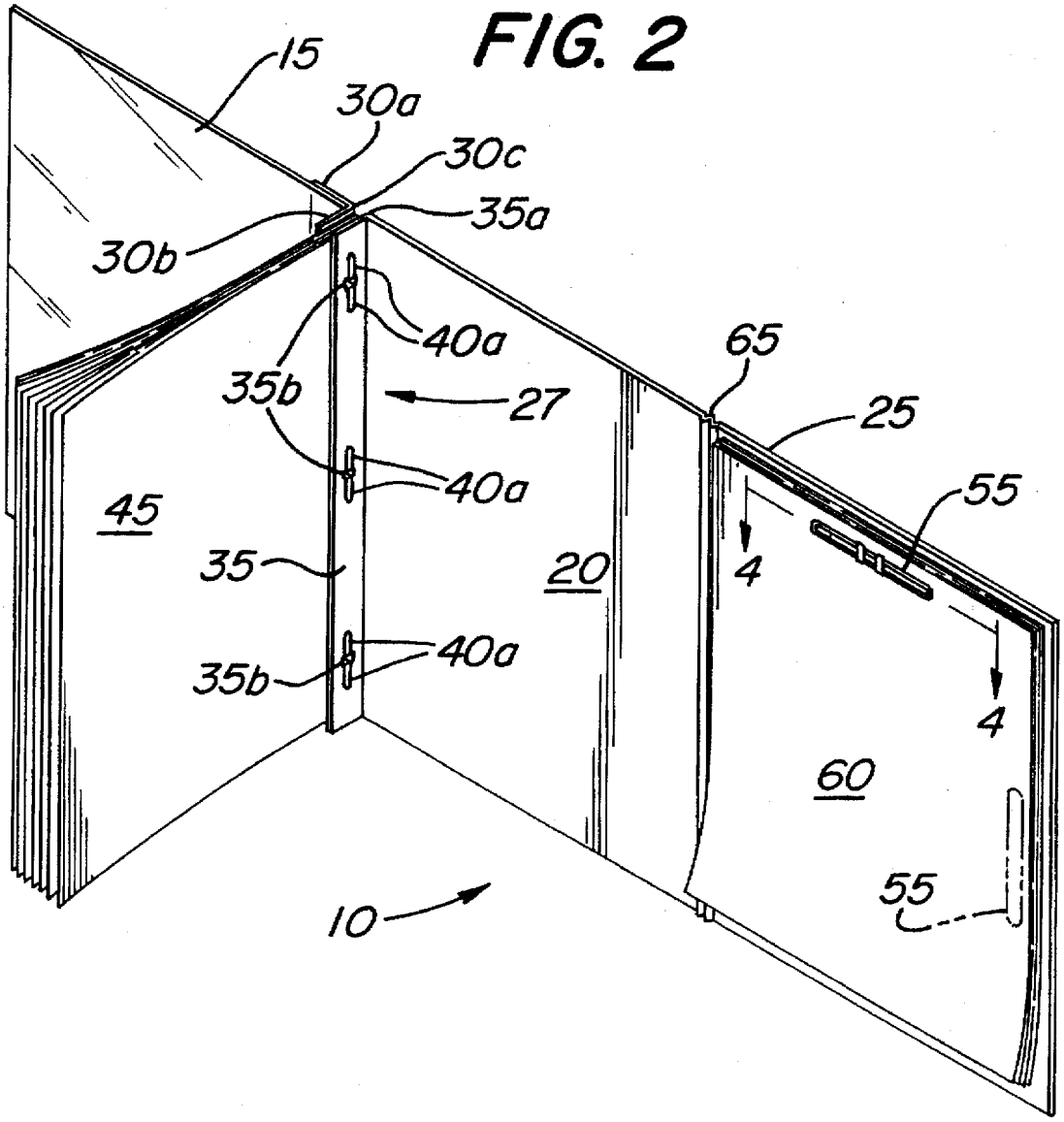
FIG. 2 is another isometric view of the preferred embodiment of the present invention in a fully opened condition for use.
Figure 4:
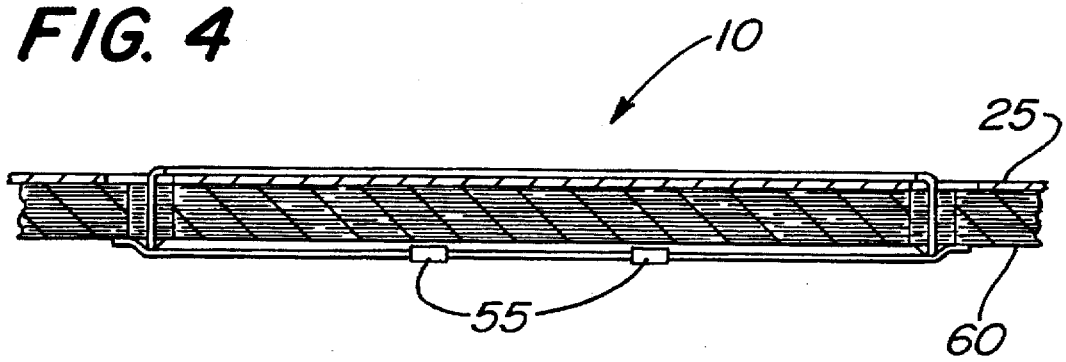
FIG. 4 is a top view of the preferred embodiment of the present invention in a fully closed and stored position.

The front panel 15 and back panel 25 are arranged to swing with respect to the center panel 20 from a fully open position, as shown in FIG. 2 to a folded, closed position, as shown in FIG. 4. It should be understood that in the preferred closed configuration, the folded back panel 25, with exhibits 60 attached thereto, lies over the center panel 20 while the transcript pages 45 lie over the folded back panel 25 and the folded front panel 15 lies over the transcript pages 45. In this folded configuration the top transcript page, which usually contains important information about the deposition, e.g., title of suit, docket number, identification of deponent and time and place of deposition, can be viewed directly through the transparent front panel 15 without having to open the cover 10.

In an alternative but less preferred closed configuration, the folded front panel 15 and transcript pages 45 lie over center panel 20 while the folded back panel 25 with exhibits 60 attached thereto lie under the center panel 20. This arrangement is somewhat less self-contained than the preferred arrangement.

In a less preferred closed configuration, the back panel 25 with exhibits 60 attached thereto is tucked between the front panel 15 and the transcript pages 45. This closed configuration is less preferred simply because the reader cannot view the top transcript page unless he opens the cover.

In another less preferred closed configuration, the folded front panel 15 and transcript pages 45 lie over the center panel 20 while the folded back panel 25 with exhibits 60 attached thereto lie over the folded front panel 15. This closed configuration is also less preferred because the reader cannot view the top transcript page unless he opens the cover.

As shown in the drawings, the preferred front panel 15 is transparent and is comprised of any suitable flexible plastic material. The front panel 15 is hingedly connected to the center panel through a two-piece hinge assembly and is arranged to swing leftwardly with respect to the center panel 20 between a closed position (FIG. 4) to an open position (FIG. 2).

Figure 3:
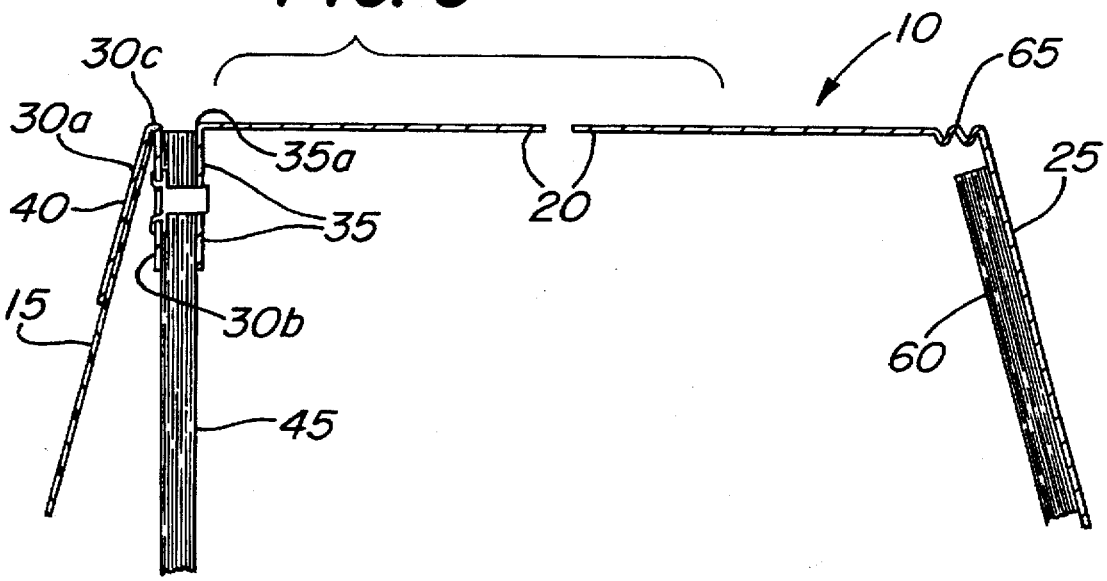
FIG. 3 is a sectional view taken along line 3—3 of FIG. 1.

As best shown in FIGS. 1 and 3, the hinge assembly includes a first hinge portion comprising flanges **30*a* and 30*b* that fold at 30*c*. As best shown in FIGS. 2 and 3, the outside surface of front panel 15 attaches to the inside surface of flange 30*a* by any suitable means, e.g., gluing. The hinge assembly further includes a second hinge portion, which is actually a strip portion 35 of the center panel 20 which folds with respect to the center panel 20 at 35*a***.

Referring again to the preferred embodiment shown in FIGS. 1, 2 and 3, the hinge assembly is provided with a page securement device 27 which could be any suitable binding means for sheet material. The page securement device 27 of the preferred embodiment comprises a plurality of fasteners 40, e.g., three, that are mounted to a corresponding number of through openings in flange **30*b* of the first hinge portion. Each fastener 40 has a pair of prongs 40*a* (FIG. 2) that extend through corresponding openings 35*b* in the strip portion 35 of the center panel 20. In this manner, transcript pages 45 may be held within the cover 10 by extending the fasteners prongs 40*a* through the punched holes in the transcript pages 45 and through the corresponding openings 35***b* in strip portion 35 and thereafter by bending the prongs 40*a* outwardly as shown in FIG. 2. Once held within the cover in this manner, pages resting on the center panel 20 may be read sequentially by the reader. Pages that have been read may be turned over so they rest upon the inside surface of the front panel 15. Whether resting on the center or front panels, the transcript pages 45 do not block from the reader's view any of the exhibit pages 60 mounted on back panel 25. In an alternative embodiment (not shown) the page securement device 27 could be a conventional ring binder comprising a plurality of snap rings and having any known means for opening the rings thereof for the reception and substitution of transcript pages.

The back panel 25 is attached to the center panel 20 by means of a hinge 65 and is arranged to swing between a closed position wherein it rests in overlying relationship with the center panel 20 (FIG. 4) and an open position as shown in FIGS. 1, 2 and 3. Preferably, the hinge 65 is an expansion hinge having multiple, spaced-apart fold zones to accommodate securement of a thick pile of exhibits 60 to the back panel 25 and still enable opening and closing of the cover 10.

The back panel 25 is provided with a binder 55 for securing exhibit pages 60 thereto. The binder 55 may be of any suitable construction, e.g., staples. One particularly effective binder is the PRESTONG-D (C) PAPER FASTENER WITH THE "ROLLED EDGE" distributed by Charles Leonard, Inc. of Glendale, N.Y. In the preferred embodiment, as best shown in FIGS. 1 and 2, the binder 55 is attached at the upper central portion of the back panel 25. In this manner, the reader may turn upwardly exhibit pages 60 that have been read or in order to gain access to other exhibit pages located thereunder. By turning exhibit pages 60 upwardly, they will not overlie or block from the reader's view the transcript pages 45.

In an alternative embodiment, as illustrated in phantom in FIG. 1, the binder 55 may be located in the center portion of the right edge of the back panel 25 to enable the reader to turn exhibit pages 60 held therein in a rightward, (i.e., counterclockwise as shown in FIG. 3) direction so they do not overlie or block from the reader's view the transcript pages 45 held within the page securement device 27. In a second alternative embodiment (not shown) the binder 55 may be located adjacent the lower edge of the back panel 25, in the center thereof, to enable the reader to turn exhibit pages 60 held therein in a downward direction so they do not overlie or block from the reader's view the transcript pages 45 held within the page securement device 27.

This invention is not limited to the precise embodiments described above with reference to the drawings, and various modifications are feasible within the scope of the ensuing claims.

What is claimed is:

1. A cover for holding multiple pages of transcribed oral testimony and for holding multiple exhibit pages mentioned in those transcript pages, said cover comprising:

a. a front panel, a center panel and a back panel;

b. said front panel being hingedly joined to said center panel by a first hinge means, said first hinge means additionally comprising attachment means located thereon for securing the transcript pages within said cover;

c. said front panel being arranged to swing from a stored position wherein said front panel is in an overlying relationship with said center panel to an open position wherein said front panel lies in an adjacent and nonoverlying relationship with said center panel, said attachment means enabling a reader to swing the transcript pages from a position overlying said center panel which provides an unobstructed view of the exhibit pages to a position overlying said front panel when said front panel is in said open position which also provides an unobstructed view of the exhibit pages;

d. said back panel being hingedly joined to said center panel by a second hinge means, said back panel being arranged to swing from a stored position wherein said back panel is in an overlying relationship with said center panel to an open position wherein said back panel lies in an adjacent and nonoverlying relationship with said center panel; and, e. said back panel additionally comprising a binding means secured thereto and arranged for securing the exhibit pages within said cover in a manner that enables the reader to swing the exhibit pages from a first position overlying said back panel which provides an unobstructed view of the transcript pages to a second position which also provides an unobstructed view of the transcript pages, thus enabling simultaneous viewing of transcript pages and exhibit pages mentioned therein and enabling the reader to swing transcript pages independently from exhibit pages.

2. The cover of claim 1 wherein said front panel is arranged to swing in a first direction with respect to said center panel from said stored position to said open position and wherein said attachment means is arranged to enable a reader to swing the transcript pages that have been read in said first direction from a position overlying said center panel to a position overlying said front panel when said front panel is in said open position.

3. The cover of claim 2 wherein said back panel is arranged to swing in a second direction with respect to said center panel from said stored position to said open position, said second direction being opposite said first direction.

4. The cover of claim 3 additionally comprising an outer side edge, said binding means being located adjacent said outer side edge of said back panel and wherein said binding means enables the reader to swing exhibits overlying said back panel in said second direction from said first position to said second position.

5. The cover of claim 3 wherein said back panel additionally comprises a top edge, said binding means being located adjacent said top edge of said back panel and wherein said binding means enables the reader to swing exhibits overlying said back panel upwardly from said first position to said second position, said second position being located above said first position.

6. The cover of claim 3 wherein said back panel additionally comprises a bottom edge, said binding means being located adjacent said bottom edge and wherein said binding means enables the reader to swing exhibits overlying said back panel downwardly from said first position to said second position, said second position being located below said first position.

7. The cover of claim 1 wherein said front panel is transparent.

8. The cover of claim 1 wherein when in said stored positions, said back panel lies over said center panel and said front panel lies over said back panel.

9. The cover of claim 1 wherein when in said stored positions, said front panel lies over said center panel and said back panel lies under said center panel.

10. The cover of claim 1 wherein when in said stored positions, said front panel lies over said center panel and said back panel lies over said front panel.

11. The cover of claim 1 wherein said first attachment means comprises a ring binder comprising a plurality of snap rings each formed of two arcuate portions which open for reception and substitution of the transcript pages.

12. The cover of claim 1 wherein said first attachment means comprises a plurality of pairs of foldable prongs.

13. A method for packaging multiple pages of transcribed oral testimony and exhibits mentioned in those transcribed pages, said method comprising the steps of:

a. providing a cover comprising a front panel, a center panel and a back panel, the front panel being hingedly joined to the center panel by a first hinge means disposed between the front and center panels, the first hinge means additionally comprising attachment means located thereon for securing transcript pages within the cover, the front panel being arranged to swing from a stored position wherein the front panel is in an overlying relationship with the center panel to an open position wherein the front panel lies in an adjacent and nonoverlying relationship with the center panel, the back panel being hingedly joined to the center panel by a second hinge means located between the center and back panels, the back panel being arranged to swing from a stored position wherein the back panel is in an overlying relationship with the center panel to an open position wherein the back panel lies in an adjacent and nonoverlying relationship with the center panel, the back panel additionally comprising a binding means secured thereto that is arranged for securing exhibits within the cover;

b. swinging the front panel of the cover from the stored position to the open position;

c. attaching multiple transcript pages to the attachment means located on the first hinge means;

d. swinging the back panel from the stored position to the open position;

e. attaching multiple exhibits to the binding means located on the back panel;

f. closing the cover.

14. The method set forth in claim 13 wherein said step of closing the cover comprises swinging the back panel over the center panel, swinging the attached transcript pages over the back panel and swinging the front panel over the attached transcript pages.

15. The method set forth in claim 13 wherein said step of closing the cover comprises swinging the back panel under the center panel, swinging the attached transcript pages over the center panel and swinging the front panel over the secured transcript pages.

16. The method set forth in claim 13 wherein said step of closing the cover comprises swinging the attached transcript pages over the center panel, swinging the front panel over the attached transcript pages and swinging the back panel over the front panel.

17. The method set forth in claim 13 wherein said step of closing the cover comprises swinging the attached transcript pages over the center panel, swinging the back panel over the attached transcript pages and swinging the cover panel over the back panel.

18. The method set forth in claim 13 wherein the attachment means comprises a plurality of fasteners, each fastener comprising a pair of bendable prongs, and wherein the multiple transcript pages are provided with punched holes, and wherein said step of attaching the multiple transcript pages to the attachment means comprises extending the prongs through the punched holes in the transcript pages and thereafter bending the prongs outwardly.

19. The method set forth in claim 13 wherein the attachment means comprises a ring binder comprising a plurality of openable snap rings and wherein the multiple transcript pages are provided with punched holes, and wherein said step of attaching multiple transcript pages to the attachment means comprises opening the snap rings, placing the punched holes of the transcript pages over the opened snap rings and thereafter closing the snap rings.

20. A cover in combination with transcript pages and exhibit pages, said transcript and exhibit pages held within said cover, said cover comprising:

a. a front panel, a center panel and a back panel, said front panel being hingedly joined to said center panel by a first hinge means and said back panel being hingedly joined to said center panel by a second hinge means, said front panel being arranged to swing from a stored position wherein said front panel is in an overlying relationship with said center panel to an open position wherein said front panel lies in an adjacent and nonoverlying relationship with said center panel, said back panel being arranged to swing from a stored position wherein said back panel is in an overlying relationship with said center panel to an open position wherein said back panel lies in an adjacent and nonoverlying relationship with said center panel;

b. attachment means disposed on said first hinge means and being arranged for securing transcript pages thereto within said cover;

c. a plurality of transcript pages held within said cover by attachment to said attachment means, said attachment means enabling a reader to swing said transcript pages from a position overlying said center panel which provides an unobstructed view of the exhibit pages to a position overlying said front panel when said front panel is in said open position which also provides an unobstructed view of the exhibit pages;

d. binding means disposed on said back panel, said binding means being arranged for securing a plurality of exhibit pages thereto within said cover; and, e. a plurality of exhibit pages held within said cover by attachment to said binding means, said binding means enabling a reader to swing exhibit pages from a first position overlying said back panel that provides an unobstructed view of the transcript pages to a second position that also provides an unobstructed view of said transcript pages thus enabling simultaneous viewing of said transcript pages and said exhibit pages mentioned therein.

21. The cover of claim 20 wherein when in said stored position, said back panel with exhibits attached thereto lies over said center panel, said transcript pages lie over said back panel and said front panel lies over said transcript pages.

22. The cover of claim 20 wherein when in said stored position, said secured transcript pages lie over said center panel, said front panel lies over said secured transcript pages and said back panel with said exhibits attached thereto lies under said center panel.

23. The cover of claim 20 wherein when in said stored position, said secured transcript pages lie over said center panel, said back panel with said exhibits attached thereto lie over said secured transcript pages and said front panel lies over said back panel.

24. The cover of claim 20 wherein when in said stored position, said secured transcript pages lie over said center panel, said front panel lies over said transcript pages and said back panel with said exhibits attached thereto lies over said front panel.

* * * * *